US008815786B2

(12) United States Patent
Meine et al.

(10) Patent No.: US 8,815,786 B2
(45) Date of Patent: Aug. 26, 2014

(54) DETERGENTS OR CLEANING AGENTS CONTAINING REACTION PRODUCTS OF ODORANTS WITH METAL OXIDES

(71) Applicant: Henkel AG & Co. KGaA, Duesseldorf (DE)

(72) Inventors: Georg Meine, Mettmann (DE); Andrea Eutebach, Wuppertal (DE); Frank Sonnenschein, Haan (DE); Ralf Bunn, Duesseldorf (DE); Sebastian Gabriel, Bevern (DE); Hubert Smyrek, Krefeld (DE); Manuela Materne, Kaarst (DE); Frank Rittler, Duesseldorf (DE)

(73) Assignee: Henkel AG & Co. KGaA, Dusseldorf (DE)

( * ) Notice: Subject to any disclaimer, the term of this patent is extended or adjusted under 35 U.S.C. 154(b) by 0 days.

(21) Appl. No.: 14/038,952

(22) Filed: Sep. 27, 2013

(65) Prior Publication Data

US 2014/0024570 A1 Jan. 23, 2014

Related U.S. Application Data

(63) Continuation of application No. PCT/EP2012/055045, filed on Mar. 22, 2012.

(30) Foreign Application Priority Data

Mar. 29, 2011 (DE) ..... 10 2011 006 315

(51) Int. Cl.
*C11D 3/50* (2006.01)

(52) U.S. Cl.
USPC ..... 510/101; 510/348; 510/349; 510/390; 510/438; 510/463; 510/508

(58) Field of Classification Search
USPC ..... 510/101, 348, 349, 390, 438, 463, 508
See application file for complete search history.

(56) References Cited

U.S. PATENT DOCUMENTS

| | | | | |
|---|---|---|---|---|
| 6,699,316 | B2 | 3/2004 | Marx et al. | |
| 7,871,973 | B1 | 1/2011 | Singleton et al. | |
| 2003/0077332 | A1* | 4/2003 | Godfrey | 424/642 |
| 2005/0191257 | A1* | 9/2005 | Brahms et al. | 424/67 |
| 2006/0229210 | A1 | 10/2006 | Neugebauer et al. | |
| 2008/0305063 | A1 | 12/2008 | Huchel et al. | |
| 2009/0035365 | A1* | 2/2009 | Popplewell et al. | 424/451 |
| 2010/0028276 | A1* | 2/2010 | Grune | 424/59 |
| 2011/0033513 | A1* | 2/2011 | Lei et al. | 424/401 |
| 2011/0097369 | A1 | 4/2011 | Sunder et al. | |

FOREIGN PATENT DOCUMENTS

| | | | |
|---|---|---|---|
| DE | 19841147 | A1 | 3/2000 |
| DE | 102008052678 | A1 | 4/2010 |
| EP | 0536942 | A2 | 4/1993 |
| GB | 1270040 | | 4/1972 |
| GB | 1505493 | | 3/1978 |
| JP | 2004-180979 | A | 7/2004 |
| WO | 97/47720 | A2 | 12/1997 |
| WO | 2008/077239 | A1 | 7/2008 |
| WO | 2008/112826 | A1 | 9/2008 |
| WO | 2009/103651 | A2 | 8/2009 |
| WO | 2010/076803 | A2 | 7/2010 |

OTHER PUBLICATIONS

PCT International Search Report (PCT/EP2012/055045) dated Jun. 15, 2012.

Reddy, "Gold Nanoparticles: Synthesis and Applications", Synlett, No. 11, pp. 1791-1792, 2006.

Schmidt, "Das Sol-Gel-Verfahren: Anorganische Synthesemethoden", Chemie in Unserer Zeit, vol. 35, No. 3, pp. 176-184, 2001.

* cited by examiner

*Primary Examiner* — Charles Boyer
(74) *Attorney, Agent, or Firm* — Ingrassia Fisher & Lorenz, P.C.

(57) ABSTRACT

Washing or cleaning agents are described which contain reaction products of odorants with metal oxides, such as for example ZnO, $ZrO_2$, $Fe_2O_3$, $Fe_3O_4$, $Al_2O_3$, $TiO_2$, $CeO_2$ and/or $SnO_2$. The reaction products are preferably produced separately and subsequently added to the washing or cleaning agent matrix. These washing or cleaning agents bring about advantages when fragrancing objects, such as for example textiles. In particular, they make it possible to achieve targeted scent release by remoistening the treated object.

16 Claims, No Drawings

DETERGENTS OR CLEANING AGENTS CONTAINING REACTION PRODUCTS OF ODORANTS WITH METAL OXIDES

CROSS-REFERENCE TO RELATED APPLICATION

This is a continuation of International Application No. PCT/EP2012/055045, filed Mar. 22, 2012, which was published under PCT Article 21(2).

TECHNICAL FIELD

The present invention generally relates to washing or cleaning agents, and more particularly relates to such washing or cleaning agents which comprise reaction products of metal oxides and odorants. It furthermore relates to a method for producing washing or cleaning agents as well as to a washing or cleaning method, to a method for fixing odorants on hard and/or textile surfaces and furthermore to a method for targeted scent release on hard and/or textile surfaces.

BACKGROUND

When using washing or cleaning agents, a consumer generally seeks not only a primary action which consists of washing or cleaning performance, but also expects an additional action which generally involves producing a pleasant odor on the target substrate, such as textiles. Washing or cleaning agents are conventionally perfumed for this purpose.

Washing or cleaning agents may be perfumed by incorporating odorants directly into the agent in question. Techniques which protect the odorants are a usual alternative. Encapsulated odorants may, for example, be used. For example, DE 10 2008 031 212 A1 describes washing or cleaning agents which contain microcapsules containing odorants. The use of "odorant precursors" has furthermore become established. The principle underlying the function of odorant precursor compounds generally involves converting odorants into compounds which do not bring about a direct scent impression but which, in response to a specific stimulus, for example on exposure to heat or acid, are capable of releasing the original odorant and thus obtain a scenting or aroma action. Oxazolidine-based odorant precursors are, for example, known. Such precursors are described in German published patent application DE 10 2006 003 092 A1. The odorant precursors described therein are bicyclic oxazolidine derivatives of scent ketones or aldehydes, such as for example decanal, which are capable of releasing the aldehydes or ketones with a scenting action on hydrolysis.

Known odorant precursors are, for example, also silicic acid esters. Such compounds are described in German published patent application DE 198 41 147 A1. These silicic acid esters contain residues of scent alcohols, such as for example octan-1-ol, and are suitable for fragrancing washing and cleaning agents since they release the alcohols with a scenting action on hydrolysis.

DE 103 37 198 A1 describes an adsorbate comprising a granular product based on pyrogenically produced silicon dioxide and aromas. An aroma containing a granular product based on pyrogenically produced silicon dioxide is also described.

JP2004180979A describes an antibacterial deodorant comprising colloidal particles of an inorganic oxide, such as in particular $TiO_2$, with a negative surface charge, onto which metallic components, such as in particular silver or zinc, adhere, in a mixture with odorants. Washing or cleaning agents are, however, not described therein.

DE 102 12 121A1 describes a method for producing nanozinc oxide dispersions which have a content of halogenated components of less than 5 weight percent (wt. %). No connection with odorants is established.

WO 2008/077239 A2 describes nanocapsules with a core-shell structure, the shell comprising at least one metal oxide. The core material may comprise odorants.

WO 2009/103651 A2 describes personal hygiene compositions which comprise cationic nanoparticles, on the surface of which are bound organic substituents which comprise at least one cationic group. Washing or cleaning agents are not described.

WO 2008/112826 A1 describes compositions which contain polymeric networks, the polymers being micro- or nanoporous. The compositions may contain perfumes.

DE 10 2008 052 678 A1 describes nanoparticles which contain cores of an inorganic material, at least one interlayer comprising silane groups and at least one outer layer comprising polyoxyalkylenemonoamines.

WO 2010/076803 A2 describes a topical multicomponent system in which at least one component comprises an active substance which is coated with a metal oxide. Washing or cleaning agents are not described.

The object of the present invention was to provide a washing or cleaning agent which enables the production of a pleasant odor on the substrates treated therewith.

Said object is achieved by the subject matter of the invention. Said subject matter comprises a washing or cleaning agent comprising reaction products of odorants with metal oxides.

Furthermore, other desirable features and characteristics of the present invention will become apparent from the subsequent detailed description and the appended claims, taken in conjunction with this background.

BRIEF SUMMARY

In an embodiment, a washing or cleaning agent comprises reaction products of odorants with metal oxides.

In an embodiment, a method for fixing odorants on hard and/or textile surfaces, comprises: treating the surface with an aqueous, optionally surfactant-containing treatment liquid comprising reaction products of odorants with metal oxides over a period of from 5 seconds to 300 minutes at a temperature of below 95° C.

In an embodiment, a method for targeted scent release on hard and/or textile surfaces, comprises: (a) treating the surface with an aqueous, preferably surfactant-containing treatment liquid comprising reaction products of odorants with metal oxides over a period of from 5 seconds to 300 minutes at a temperature of below 95° C., (b) leaving the treated surface to dry and, at a later point in time, (c) releasing scent by input of moisture.

DETAILED DESCRIPTION

The following detailed description is merely exemplary in nature and is not intended to limit the invention or the application and uses of the invention. Furtheimore, there is no intention to be bound by any theory presented in the preceding background or the following detailed description.

"Odorants" is the name for chemical compounds with an odor which in humans trigger a preferably pleasant odor sensation and are therefore used for perfuming or fragrancing industrial and sanitary articles, soaps, personal hygiene products, washing agents, cleaning agents and the like. The terms "odorant" and "scent" should be taken to be synonymous for the purposes of the present invention.

Metal oxides are chemical compounds of a metal with oxygen.

For the purposes of the present invention, "reaction products of odorants with metal oxides" are those products which are obtained by the interaction which occurs when the starting materials, namely odorants and metal oxides, are mixed or brought into contact. Coordination compounds may here in particular be formed. The odorants may likewise be adsorbed or accumulate on the surface of the metal oxides. The interaction between the odorants and the metal oxides gives rise to a modification of the odorants which surprisingly leads to distinct advantages when fragrancing objects, in particular textiles, compared with odorants which have not been caused to interact with metal oxides. These advantages will be described in greater detail below. The reaction products are in particular obtainable by jointly dissolving or dispersing the metal oxides and odorants, optionally with input of thermal energy.

It is also possible, albeit less preferred, for the metal oxide to be introduced as a solution or dispersion directly into the target product, for example a liquid washing agent, and subsequently to add the odorants or perfume oils, such that the reaction products are first formed in the target product, for example a liquid washing agent. This procedure is in principle possible, but less preferred because secondary reactions may occur in this case and, depending on the target product, only limited interaction may occur between the odorants and the metal oxides, such that the effectiveness of the interaction is as a rule distinctly reduced. It is therefore particularly preferred firstly to produce a reaction product from odorants and metal oxides in a separate step and subsequently to add said separately produced reaction product to the target product, for example a washing agent. To this end, a solution or dispersion of the starting materials is preferably firstly produced, and said mixture is advantageously stirred over a period of at least 1 minute at room temperature (21° C.). Thermal energy may preferably also be supplied, for example by heating to 60° C.

It is thus a particularly preferred embodiment of the invention to produce the reaction products according to the invention prior to addition to the washing or cleaning agent and then to add them to the washing or cleaning agent according to the invention.

The particle size of the metal oxides used may in principle be freely selected. It is, however, preferred for the metal oxides to have particle sizes ≤1000 micrometers (μm), advantageously ≤500 μm, more advantageously ≤100 μm, preferably ≤1 μm, in particular ≤0.1 μm. A possible lower limit for particle size may for example be 1 nm or 10 nm.

Particle size is here taken to mean the greatest longitudinal extent of the individual particle. A person skilled in the art can determine particle size in many and varied ways. Particle size may preferably be determined by optical methods with the assistance, depending on particle size, of light microscopy or electron microscopy.

According to a preferred embodiment of the invention, metal oxide nanoparticles, i.e. particles of metal oxides, the dimensions of which are in the range from 1 nanometer (nm) to 100 nm, may in particular also be used in order to obtain the reaction products according to the invention by the reaction thereof with odorants. Synthesizing metal oxide nanoparticles as such, for example zinc oxide nanoparticles, iron oxide nanoparticles, tin oxide nanoparticles, zirconium dioxide nanoparticles or aluminum oxide nanoparticles, is a trivial matter. Metal oxide nanoparticles are generally produced in a sol-gel process. To this end, the starting materials, usually metal alkoxides, are generally initially introduced in homogeneously dissolved form in an aqueous medium. In the first reaction step, the metal alkoxides undergo hydrolysis with elimination of alcohol. The resultant molecules then undergo polycondensation with elimination of water, such that, given suitable selection of reaction conditions, inorganic sol particles with sizes in the nanometer range are obtained. The sol-gel synthesis method is described in detail in the literature, see for example Schmidt, Chem. Unserer Zeit, (2001) 35(3), 176.

The washing or cleaning agent according to the invention enables the production of a pleasant odor on the substrates treated therewith. The invention is, however, associated with some more advantages. One significant advantage consists in that the invention enables a scent effect by remoistening. This means that objects, for example textiles, treated with the washing or cleaning agent according to the invention, once dried surprisingly then release a particularly intense scent again when they are moistened again. This effect is advantageous for many day-to-day activities. For example, a hand towel treated with the washing or cleaning agent according to the invention has a scent action due to the moisture absorbed when drying for example dishes or the human body. For example a renewed scent effect may be triggered by body moisture on corresponding underwear, for example an undershirt This effect, namely renewed release of a pleasant odor after remoistening, does not occur when using conventional washing or cleaning agents, i.e., it is not conventionally expected for a hand towel to release scent as soon as it is remoistened.

A further advantage resides in the improvement of odorant absorptivity from aqueous, preferably surfactant-containing solutions onto the treated objects, such as in particular textiles. This applies not only to the odorants introduced via the reaction products according to the invention, but instead also to other odorants which are not introduced into the system via the reaction products according to the invention in the system introduced. This enables improved efficiency in odorant use. A further advantage resides in improved fixation of odorants to soft and hard surfaces, such as for example textiles, skin and hair or hard surfaces. Improved fixation is here taken to mean improved, i.e., stronger adhesion of the odorants already deposited on the objects. Furthermore, on release of odorants from the reaction products deposited onto the treated objects, it is possible for other components, in particular malodor components to be bound to the metal oxide. Malodor components are volatile compounds with foul-smelling groups, for example amine derivatives and sulfur derivatives. The present invention is thus capable of achieving not only targeted release of scents, but also absorption and thus reduction of off-odors.

The metal oxides may in principle be freely selected for the purposes of the invention, but it is a preferred embodiment of the invention for the metal oxides used to be selected from $ZnO$, $ZrO_2$, $Fe_2O_3$, $Al_2O_3$, $TiO_2$, $CeO_2$, $Fe_3O_4$ and/or $SnO_2$. These provide particularly advantageous scent advantages, in particular with regard to the described scent release by remoistening.

The odorants usable for the purposes of the invention may in principle, with regard to the reaction products according to the invention, be freely selected. Preferred odorants are those which are capable of acting as electron pair donors, namely those molecules which are capable of providing a free electron pair for bonding with a Lewis acid.

A preferred embodiment of the invention is one in which the odorants, with regard to the reaction products according to the invention, are selected from dihydromyrcenol (CAS number: 18479-58-8), acedyl (CAS number: 5413-60-5), propidyl (CAS number: 17511-60-3), triplal (CAS number: 68039-49-6), hexyl acetate, 2-tert.-butylcyclohexyl acetate, 4-tert.-butylcyclohexyl acetate, linalyl acetate, terpinyl acetate (CAS number 8007-35-0), ethylene brassylate (CAS number 105-95-3), applelide (CAS number: 478695-70-4), filial, cyclamen aldehyde (CAS number: 103-95-7), cyclogalbanate (CAS number: 68901-15-5), allyl amyl glycolate (CAS number: 67634-00-8), ethyl-2-methyl butyrate (CAS number: 7452-79-1), amyl acetate, 2-methyl undecanal, decanal, dihydrofloriffone (CAS number: 71048-82-3), florhydral (CAS number: 125109-85-5), limonene, undecavertol (CAS Number: 81782-77-6), amyl salicylate (CAS number: 2050-08-0), cashmeran (CAS number: 33704-61-9), alpha-damascone, beta-damascone, delta-damascone, isodamascone and/or damascenone.

It is a further preferred embodiment of the invention for the metal oxide used according to the invention to be doped with metal nanoparticles with dimensions ≤100 nm, preferably ≤10 nm, in particular gold, silver, platinum, palladium and/or iron nanoparticles.

The production of metal nanoparticles is known from the literature. An overview of synthesis methods may, for example, be found in Reddy, V. R., Synlett, (2006) 11, 1791. Metal nanoparticles may generally be produced via a reduction method. Metal salts as starting materials are usually initially introduced in homogeneously dissolved form in aqueous or organic media. Ultrafine metal nuclei are then formed by admixing a reducing agent. The nanoparticles are generally stabilized by suitable ligands in order to avoid aggregation of the nanoparticles. The metal oxide used according to the invention is preferably doped with metal nanoparticles by mixing the metal nanoparticles with the metal oxide to be doped, in particular in aqueous or organic media.

The quantity of metal oxide introduced into the washing or cleaning agent via the reaction product according to the invention may in principle be freely selected.

If the quantity of metal oxide present, preferably introduced into the washing or cleaning agent via the reaction product according to the invention, amounts to 0.00001 to 10 wt. %, preferably 0.01 to 1 wt. %, relative to the entire washing or cleaning agent, a preferred embodiment of the invention is provided.

The quantity of odorants present in the washing or cleaning agent according to the invention may in principle be freely selected and is preferably determined on the basis of the intended purpose of the agent in question. According to a preferred embodiment of the invention, the quantity of odorants present amounts to 0.00001 to 80 wt. %, preferably 0.01 to 15 wt. %, relative to the entire washing or cleaning agent.

According to a further preferred embodiment of the invention, the washing or cleaning agent according to the invention contains 0.0001 to 95 wt. %, preferably 0.01 to 40 wt. % surfactants.

Particularly high surfactant contents may for example be achieved in toilet soaps (tablet soaps).

A particularly preferred washing or cleaning agent according to the invention contains (i) 0.00001 to 10 wt. %, preferably 0.01 to 1 wt. % metal oxide, which was preferably introduced into the washing or cleaning agent via the reaction product according to the invention, (ii) 0.00001 to 80 wt. %, preferably 0.01 to 15 wt. % odorants, (iii) 0.0001 to 95 wt. %, preferably 0.01 to 40 surfactants, wt. % relative to the entire agent.

Further conventional washing or cleaning agent ingredients may additionally be present.

In a preferred embodiment, the washing or cleaning agents according to the invention are produced by firstly producing the reaction product according to the invention and then incorporating said reaction product into the washing or cleaning agent matrix. Alternatively, the metal oxide product may firstly be incorporated into the product, after which the perfume oil or the individual components thereof are added. This is, however, less preferred since this type of reaction is less efficient and also associated with secondary reactions.

The present invention accordingly further provides a method for producing a washing or cleaning agent, in which a reaction product of odorants with metal oxides is produced and said reaction product is combined with the washing or cleaning agent matrix. The previously stated explanations apply with regard to the reaction product.

The present invention also provides a washing or cleaning method, in which hard and/or textile surfaces are brought into contact with a treatment liquid which contains a washing or cleaning agent according to the invention. The advantage of this method is inter alia that the surfaces treated in this manner release a pleasant scent after remoistening, such that targeted scent release is enabled.

The present invention also provides a method for fixing odorants on hard and/or textile surfaces, in which the surface is treated with an aqueous, preferably surfactant-containing treatment liquid comprising reaction products of odorants with metal oxides over a period of from 5 seconds to 300 minutes at a temperature of below 95° C.

The present invention also provides a method for targeted scent release on hard and/or textile surfaces, in which (a) the surface is treated with an aqueous, preferably surfactant-containing treatment liquid comprising reaction products of odorants with metal oxides over a period of from 5 seconds to 300 minutes at a temperature of below 95° C., (b) the treated surface is left to dry and, at a later point in time, (c) scent is released by input of moisture.

Further optional ingredients of the washing or cleaning agents according to the invention are explained in some cases in greater detail. For clarity's sake, it should be noted that, for the purposes of the invention, the term washing or cleaning agent also includes post-treatment agents. These in particular include not only rinse conditioners, disinfectant rinses and dryer sheets, but also textile fresheners and ironing aids.

The corresponding agents preferably contain the components conventional for the product category in question. For example, a disinfectant rinse conventionally contains active substances which, depending on the individual case, are capable of killing a wide range of viral, bacterial and fungal organisms. Such active substances, such as for example alkylbenzyldimethylammonium chloride, are known per se to a person skilled in the art. Rinse conditioners for example contain softening active substances, generally cationic surfactants, preferably ester quats, i.e. quaternary ammonium compounds with two hydrophobic residues, each of which contains an ester group as a "predetermined breaking point" to facilitate biodegradation. Textile fresheners are in particular conditioning agents for spraying on household textiles in order to absorb volatile, unpleasant-smelling molecules and mask them with pleasant scents. Cyclodextrins are, for example, used for absorption in conventional textile fresheners. Dryer sheets are intended for use in a tumble dryer. These are sheets onto which are applied certain active substances, such that the textiles crease less and do not so readily become electrostatically charged.

The most preferred agents for the purposes of the invention are washing agents and rinse conditioners as well as cleaning agents for hard surfaces.

In addition to the reaction product according to the invention, the washing or cleaning agents according to the invention preferably contain at least one, preferably a plurality of, active components, in particular components with a detergent, conditioning and/or cleaning action, advantageously selected from the group comprising anionic surfactants, cationic surfactants, amphoteric surfactants, nonionic surfactants, acidifying agents, alkalizing agents, anticrease compounds, antibacterial substances, antioxidants, antiredeposition agents, antistatic agents, builder substances (builders), bleaching agents, bleach activators, bleaching stabilizers, bleach catalysts, ironing aids, odorants, shrinkage prevention agents, electrolytes, enzymes, color protectants, colorants, dye transfer inhibitors, fluorescent agents, fungicides, germicides, odor-complexing substances, hydrotropes, rinse aids, complexing agents, preservatives, corrosion inhibitors, optical brighteners, pearlescent agents, pH adjusting agents, waterproofing and impregnation agents, polymers, antiswelling and antislip agents, foam inhibitors, phyllosilicates, dirt-repellent substances, silver protection agents, silicone oils, UV protection substances, viscosity regulators, thickeners, discoloration inhibitors, graying inhibitors, vitamins and/or finishing active substances.

The quantities of the further possible ingredients in the washing or cleaning agents according to the invention are in each case determined on the basis of the intended purpose of the agent in question and a person skilled in the art is in principle familiar with the orders of magnitude of the quantities to be used of the optional ingredients or can find such details in the relevant specialist literature.

Depending on the intended purpose of the washing or cleaning agents according to the invention, a higher or lower surfactant content will for example be selected. For example, the surfactant content of washing agents for example is conventionally between for example 5 and 50 wt. %, preferably between 10 and 30 wt. % and in particular between 15 and 25 wt. %, while cleaning agents for automatic dishwashing conventionally contain between for example 0.1 and 10 wt. %, preferably between 0.5 and 7.5 wt. % and in particular between 1 and 5 wt. % surfactants.

The washing or cleaning agents according to the invention may preferably contain surfactants, in which in particular not only anionic surfactants, nonionic surfactants and mixtures thereof, but also cationic surfactants may be considered.

Optionally usable nonionic surfactants include the alkoxylates, in particular the ethoxylates and/or propoxylates, of saturated or mono- to polyunsaturated linear or branched-chain alcohols with 10 to 22 C atoms, preferably 12 to 18 C atoms. The degree of alkoxylation of the alcohols is here generally between 1 and 20, preferably between 3 and 10. They may be produced in known manner by reacting the corresponding alcohols with the corresponding alkylene oxides. Fatty alcohol derivatives are in particular suitable, although the branched-chain isomers thereof, in particular "oxo" alcohols, may be used to produce usable alkoxylates. The alkoxylates, in particular ethoxylates, of primary alcohols with linear, in particular dodecyl, tetradecyl, hexadecyl or octadecyl residues and mixtures thereof are accordingly usable. Corresponding alkoxylation products of alkylamines, vicinal diols and carboxamides which correspond to the stated alcohols with regard to the alkyl moiety, are moreover usable. The ethylene oxide and/or propylene oxide insertion products of fatty acid alkyl esters and fatty acid polyhydroxyamides may also be considered.

Particularly preferred alkoxylates are those which are obtained by ethoxylating linear primary alcohols, in particular by ethoxylating corresponding linear primary alcohols with chain lengths of C14 and C15.

Further particularly preferred alkoxylates are those which are obtained by ethoxylating branched primary alcohols, in particular by ethoxylating corresponding branched primary alcohols with 11 to 36 carbon atoms and on average 0.7 to 3.0 branches per molecule, said branches comprising methyl and ethyl branches. Such alkoxylates are described in U.S. Pat. No. 7,871,973 B1.

Surfactants based on 2-propylheptanol, in particular sulfates, ethoxylates and ether sulfates derived therefrom are particularly suitable for washing at low temperatures. Ethoxylates based on 2-propylheptanol, in particular mixed with C16/C18 fatty alcohol ethoxylates are here particularly preferred. Surfactants based on isotridecanol, in particular ethoxylates based on isotridecanol, are also advantageous.

"Alkyl polyglycosides" suitable for optional incorporation into the agents according to the invention are compounds of the general formula $(G)_n$-$OR^8$, in which $R^8$ means an alkyl or alkenyl residue with 8 to 22 C atoms, G a glycose unit and n a number between 1 and 10. The glycoside component $(G)_n$ comprises oligomers or polymers prepared from naturally occurring aldose or ketose monomers, which in particular include glucose, mannose, fructose, galactose, talose, gulose, altrose, allose, idose, ribose, arabinose, xylose and lyxose. The oligomers consisting of such glycosidically linked monomers are characterized, apart from by the nature of the sugars contained therein, by the number thereof, the "degree of oligomerization". Since it has to be determined analytically, the degree of oligomerization n generally assumes fractional numerical values; these values are between 1 and 10, in the case of preferably used glycosides below a value of 1.5, in particular between 1.2 and 1.4. Glucose is the preferred monomer building block due to its ready availability. The alkyl or alkenyl moiety $R^8$ of the glycosides preferably likewise originates from readily available derivatives of renewable raw materials, in particular from fatty alcohols, although the branched-chain isomers thereof, in particular "oxo" alcohols, may be used to produce usable glycosides. Primary alcohols with linear octyl, decyl, dodecyl, tetradecyl, hexadecyl or octadecyl residues and mixtures thereof are accordingly in particular usable. Particularly preferred alkyl glycosides contain a coconut fatty alkyl residue, i.e. mixtures with substantially $R^8$=dodecyl and $R^8$=tetradecyl.

Nonionic surfactant is preferably optionally present in washing or cleaning agents according to the invention in quantities of 0.1 wt. % to 30 wt. %, in particular of 1 wt. % to 25 wt. %, wt. % relative to the entire washing or cleaning agent.

Instead of or in addition thereto, the washing or cleaning agents may contain further optional surfactants, preferably anionic surfactants.

Anionic surfactants of the sulfate or sulfonate type are preferably optionally present in quantities of preferably no more than 30 wt. %, in particular of 0.1 wt. % to 18 wt. %, in each case relative to the entire washing or cleaning agent. Anionic surfactants which may be mentioned as particularly suitable for use in the washing or cleaning agents according to the invention are alkyl and/or alkenyl sulfates with 8 to 22 C atoms which bear an alkali metal-, ammonium- or alkyl- or hydroxyalkyl-substituted ammonium ion as countercation. The derivatives of fatty alcohols with in particular 12 to 18 C atoms and the branched-chain analogs thereof, namely "oxo" alcohols, are preferred. The alkyl and alkenyl sulfates may be produced in known manner by reacting the corresponding alcohol component with a conventional sulfation reagent, in particular sulfur trioxide or chlorosulfonic acid, and subsequent neutralization with alkali metal-, ammonium- or alkyl- or hydroxyalkyl-substituted ammonium bases. Such alkyl and/or alkenyl sulfates are preferably optionally present in the washing or cleaning agents in quantities of 0.1 wt. % to 20 wt. %, in particular of 0.5 wt. % to 18 wt. %.

Usable surfactants of the sulfate type also include the sulfated alkoxylation products of the stated alcohols, namely "ether sulfates". Such ether sulfates preferably contain 2 to 30, in particular 4 to 10, ethylene glycol groups per molecule. Usable anionic surfactants of the sulfonate type include the α-sulfo esters obtainable by reacting fatty acid esters with sulfur trioxide and subsequent neutralization, in particular the sulfonation products derived from fatty acids with 8 to 22 C atoms, preferably 12 to 18 C atoms, and linear alcohols with 1 to 6 C atoms, preferably 1 to 4 C atoms, and the sulfofatty acids obtained from said sulfonation products by formal saponification.

Particularly preferred optionally usable anionic surfactants are alkylbenzenesulfonates, such as for example sodium dodecylbenzenesulfonate.

Anionic surfactant is preferably optionally present in washing or cleaning agents according to the invention in quantities of 0.1 wt. % to 30 wt. %, in particular of 1 wt. % to 25 wt. %, wt. % relative to the entire washing or cleaning agent.

Soaps may be considered as further optionally usable surfactant ingredients of the washing or cleaning agents, suitable soaps being saturated fatty acid soaps, such as the salts of lauric acid, myristic acid, palmitic acid or stearic acid, and soaps derived from natural fatty acid mixtures, for example coconut, palm kernel or tallow fatty acids. In particular, such soap mixtures which are preferred are those which are composed to an extent of 50 to 100 wt. % of saturated C12-C13 fatty acid soaps and to an extent of up to 50 wt. % of oleic acid soap. Soap is preferably optionally present in washing or cleaning agents according to the invention in quantities of 0.1 wt. % to 5 wt. %. In particular in liquid washing or cleaning agents, however, larger quantities of soap of up to 20 wt. % may optionally be present.

Cationic surfactants may also optionally be present in the washing or cleaning agents according to the invention, in particular in the laundry post-treatment agent according to the invention. Examples of cationic surfactants are quaternary ammonium compounds with preferably one or in particular two hydrophobic alkyl residues. Ester quats are particularly preferred, i.e. quaternary ammonium compounds with two hydrophobic residues, each of which contains an ester group as a "predetermined breaking point" to facilitate biodegradation. Preferably usable ester quats are methyl-N-(2-hydroxyethyl)-N,N-di(tallowacyloxyethyl)ammonium methosulfate, bis-(palmitoyloxyethyl)-hydroxyethylmethylammonium metho sulfate, 1,2-bis-[tallowacyloxy]-3-trimethylammoniumpropane chloride, N,N-dimethyl-N,N-di(tallowacyloxyethyl)ammonium methosulfate or methyl-N,N-bis(stearoyloxyethyl)-N-(2-hydroxyethyl)ammonium methosulfate. The cationic surfactants are preferably present in the agents according to the invention in quantities of 0.05 to 20 wt. %, relative to the total agent. Quantities of 0.1 to 5 wt. % are particularly preferred.

According to a preferred embodiment of the invention, surfactants are present in washing or cleaning agents according to the invention in a total quantity of preferably 5 wt. % to 50 wt. %, in particular of 8 wt. % to 30 wt. %. In particular in laundry post-treatment agents, surfactants are preferably used in an amount of up to 30 wt. %, in particular of 5 wt. % to 15 wt. %, said surfactant preferably comprising at least a proportion of cationic surfactants.

A washing or cleaning agent according to the invention may preferably contain at least one builder, preferably a water-soluble and/or water-insoluble, organic and/or inorganic builder. It is preferred to use water-soluble builders.

Water-soluble organic builder substances include polycarboxylic acids, in particular citric acid and saccharic acids, monomeric and polymeric aminopolycarboxylic acids, in particular methylglycinediacetic acid, nitrilotriacetic acid and ethylenediaminetetraacetic acid together with polyaspartic acid, polyphosphonic acids, in particular aminotris(methylenephosphonic acid), ethylenediaminetetrakis(methylenephosphonic acid) and 1-hydroxyethane-1,1-diphosphonic acid, polymeric hydroxyl compounds such as dextrin and polymeric (poly-) carboxylic acids, polymeric acrylic acids, methacrylic acids, maleic acids and copolymers thereof, which may also contain small proportions of polymerizable substances without carboxylic acid functionality. Suitable, albeit less preferred, compounds of this class are copolymers of acrylic acid or methacrylic acid with vinyl ethers, such as vinyl methyl ethers, vinyl esters, ethylene, propylene and styrene, the acid fraction of which amounts to at least 50 wt. %.

Organic builder substances may, if desired, be present in the washing or cleaning agents according to the invention in quantities of up to 40 wt. %, in particular of up to 25 wt. % and preferably of 1 wt. % to 8 wt. %. Quantities close to the stated upper limit are preferably used in pasty or liquid, in particular hydrous, washing or cleaning agents according to the invention. Washing or cleaning agents according to the invention, such as for example rinse conditioners, may optionally contain no organic builder.

Water-soluble inorganic builder materials which may be considered are in particular alkali metal silicates and polyphosphates, preferably sodium triphosphate. Water-insoluble, water-dispersible inorganic builder materials which are optionally used in the washing or cleaning agents according to the invention are in particular crystalline or amorphous alkali metal aluminosilicates in quantities of for example up to 50 wt. %, preferably of no more than 40 wt. % and, in liquid agents, in particular from 1 wt. % to 5 wt. %. Among these, washing agent grade crystalline sodium aluminosilicates, in particular zeolite A, P and optionally X, are preferred. Quantities close to the stated upper limit are preferably optionally used in solid, particulate agents. Suitable substitutes or partial substitutes for the stated aluminosilicate are crystalline alkali metal silicates, which may be present alone or mixed with amorphous silicates. The alkali metal silicates usable as builders in the washing or cleaning agents according to the invention preferably have a molar ratio of alkali metal oxide to $SiO_2$ of below 0.95, in particular of 1:1.1 to 1:12 and may be in amorphous or crystalline form. Amorphous alkali metal silicates are preferred.

It is furthermore preferred for the purposes of a further preferred embodiment to use at most small quantities of water-insoluble builder materials (such as for example zeolite), for example in quantities of 0-5 wt. %, for example 0.1 to 2 wt. %, relative to the entire washing or cleaning agent.

Builder substances are preferably optionally present in the washing or cleaning agents according to the invention in quantities of up to 60 wt. %, in particular of 5 wt. % to 40 wt. %. Laundry post-treatment agents according to the invention, such as for example rinse conditioners, preferably contain no inorganic builder.

Optionally usable peroxy compounds which may in particular be considered are organic peracids or peracidic salts of organic acids, such as phthalimidopercaproic acid, perbenzoic acid or salts of diperdodecanedioic acid, hydrogen peroxide and inorganic salts, such as perborate, percarbonate and/or persilicate, which release hydrogen peroxide under the conditions of use. Where solid peroxy compounds are to be used, they may be used in the form of powders or granules, which may also in principle be encapsulated in known manner. Alkali metal percarbonate, alkali metal perborate monohydrate or, in particular in liquid agents, hydrogen peroxide in the form of aqueous solutions containing 3 wt. % to 10 wt. % hydrogen peroxide may particularly preferably be used. If a washing or cleaning agent according to the invention contains bleaching agents, in particular peroxy compounds, these are preferably present in quantities of up to 50 wt. %, in particular of 5 wt. % to 30 wt. %. It may be appropriate optionally to add small quantities of known bleaching agent stabilizers, such as for example phosphonates, borates or metaborates and metasilicates and magnesium salts such as magnesium sulfate.

Bleach activators which may optionally be used are compounds which, under perhydrolysis conditions, yield aliphatic peroxycarboxylic acids with preferably 1 to 10 C atoms, in particular 2 to 4 C atoms, and/or optionally substituted perbenzoic acid. Suitable substances are those which bear O- and/or N-acyl groups having the stated number of C atoms and/or optionally substituted benzoyl groups. Preferred compounds are polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, n-nonanoyl- or isononanoyloxybenzenesulfonate (n- or iso-NOBS), carboxylic anhydrides, in particular phthalic anhydride, acylated polyhydric alcohols, in particular triacetin, ethylene glycol diacetate, 2,5-diacetoxy-2,5-dihydrofuran and enol ester and acetylated sorbitol and mannitol or mixtures thereof, acylated sugar derivatives, in particular pentaacetyl glucose (PAG), pentaacetyl fructose, tetraacetyl xylose and octaacetyl lactose and acetylated, optionally N-alkylated glucamine and gluconolactone, and/or N-acylated lactams, for example N-benzoyl caprolactam. Hydrophilically substituted acyl acetals and acyl lactams are likewise preferably used. Combinations of conventional bleach activators may also be used. Such bleach activators may optionally be present in conventional quantity ranges, preferably in quantities of 1 wt. % to 10 wt. %, in particular 2 wt. % to 8 wt. %, relative to the entire agent.

Enzymes which are optionally usable in the washing or cleaning agents and may in particular be considered are those from the class of proteases, cutinases, amylases, pullulanases, hemicellulases, cellulases, lipases, oxidases and peroxidases and mixtures thereof. Enzymatic active substances which are particularly suitable are those obtained from fungi or bacteria, such as *Bacillus subtilis, Bacillus licheniformis, Streptomyces griseus, Humicola lanuginosa, Humicola insolens, Pseudomonas pseudoalcaligenes* or *Pseudomonas cepacia*. The optionally used enzymes may be adsorbed onto carrier substances and/or be embedded in encapsulating substances in order to protect them from premature inactivation They are preferably optionally present in the washing or cleaning agents according to the invention in quantities of up to 5 wt. %, in particular of 0.2 wt. % to 2 wt. %.

The washing or cleaning agents may optionally contain for example derivatives of diaminostilbene disulfonic acid or the alkali metal salts thereof as optical brighteners. Suitable compounds are, for example, salts of 4,4'-bis(2-anilino-4-morpholino-1,3,5-triazinyl-6-amino)stilbene 2,2'-disulfonic acid or compounds of similar structure which, instead of the morpholino group, bear a diethanolamino group, a methylamino group, an anilino group or a 2-methoxyethylamino group. Brighteners of the substituted diphenylstyryl type may furthermore be present, for example the alkali metal salts of 4,4'-bis(2-sulfostyryl)-diphenyl, 4,4'-bis(4-chloro-3-sulfostyryl)-diphenyl, or 4-(4-chlorostyryl)-4'-(2-sulfostyryl)-diphenyl. Mixtures of the above-stated brighteners may also be used.

Optionally usable foam inhibitors include, for example, organopolysiloxanes and mixtures thereof with microfine, optionally silanized silica as well as paraffin waxes and mixtures thereof with silanized silica or bis-fatty acid alkylenediamides. Mixtures of different foam inhibitors may also advantageously be used, for example mixtures of silicones, paraffins or waxes. The optional foam inhibitors, in particular foam inhibitors containing silicone and/or paraffin, are preferably bound to a granular carrier substance which is soluble or dispersible in water. Mixtures of paraffin waxes and bis-stearyl ethylenediamides are particularly preferred here.

The washing or cleaning agents may optionally also additionally contain components which have a positive impact on the removability of oil and grease from textiles by washing, namely soil-release active substances. This effect is particularly clear when a textile is soiled which has already previously been washed repeatedly with a washing agent which contains this oil and grease dissolving component. Preferred oil and grease dissolving components include, for example, nonionic cellulose ethers such as methylcellulose and methylhydroxypropylcellulose with a content of methoxy groups of 15 to 30 wt. % and of hydroxypropoxyl groups of 1 to 15 wt. %, in each case relative to the nonionic cellulose ethers, as well as the polymers known from the prior art of phthalic acid and/or terephthalic acid or of the derivatives thereof with monomeric and/or polymeric diols, in particular polymers prepared from ethylene terephthalates and/or polyethylene glycol terephthalates or anionically and/or nonionically modified derivatives of these.

The washing or cleaning agents may optionally also contain dye transfer inhibitors, preferably in quantities of 0.1 wt. % to 2 wt. %, in particular 0.1 wt. % to 1 wt. %, which in a preferred development of the invention are polymers of vinylpyrrolidone, vinylimidazole, vinylpyridine N-oxide or copolymers of these. Usable substances are not only polyvinylpyrrolidones, N-vinylimidazole/N-vinylpyrrolidone copolymers, polyvinyloxazolidones, copolymers based on vinyl monomers and carboxamides, polyesters and polyamides containing pyrrolidone groups, grafted polyamidoamines and polyethyleneimines, polymers with amide groups derived from secondary amines, polyamine N-oxide polymers, polyvinyl alcohols but also copolymers based on acrylamidoalkenylsulfonic acid.

Optionally usable graying inhibitors have the ability to keep dirt which has been dissolved from the textile fibers suspended in the liquor. Water-soluble colloids of a mainly organic nature are suitable for this purpose, for example starch, size, gelatin, salts of ether carboxylic acids or ether sulfonic acids of starch or cellulose or salts of acidic sulfuric acid esters of cellulose or starch. Water-soluble polyamides containing acidic groups are also suitable for this purpose. Derivatives of starch other than those stated above, for example aldehyde starches, may further be used. Cellulose ethers, such as carboxymethylcellulose (Na salt), methylcellulose, hydroxyalkylcellulose and mixed ethers, such as methylhydroxyethylcellulose, methylhydroxypropylcellulose, methylcarboxymethylcellulose and mixtures thereof, may preferably be used as optional graying inhibitors, for example in quantities of 0.1 to 5 wt. % relative to the washing or cleaning agent.

Organic solvents other than water which are optionally usable in the washing or cleaning agents according to the invention, in particular if these are in liquid or pasty form, include alcohols with 1 to 4 C atoms, in particular methanol, ethanol, isopropanol and tert.-butanol, diols with 2 to 4 C atoms, in particular ethylene glycol and propylene glycol, and mixtures thereof and the ethers derivable from the stated classes of compounds. Such water-miscible solvents may be optionally present in the washing or cleaning agents according to the invention preferably in quantities of no more than 30 wt. %, in particular of 6 wt. % to 20 wt. %.

Alcohols and/or organic solvents in an amount of up to 50% may also be used to boost washing and cleaning performance. In particular, it is preferred to use a liquid, hydrophobic compound selected from limonene, dioctyl ether, lauric acid hexyl ester, decamethylcyclopentasiloxane, $C_{11-13}$ isoparaffin and mixtures thereof, preferably in combination with fatty acid soap and/or non-neutralized fatty acid.

In order to establish a desired pH value which is not automatically obtained by mixing the remaining components, the washing or cleaning agents according to the invention may optionally contain acids, in particular citric acid, acetic acid, tartaric acid, malic acid, lactic acid, glycolic acid, succinic acid, glutaric acid and/or adipic acid, as well as mineral acids, in particular sulfuric acid, or bases, in particular ammonium or alkali metal hydroxides. Such pH regulators may optionally be present in the washing or cleaning agents according to the invention in quantities of preferably no more than 20 wt. %, in particular of 1.2 wt. % to 17 wt. %.

Any substances and mixtures known for this purpose may be used as scents or odorants or perfume oils. For the purposes of the present invention, the terms "odorant(s)", "scents" and "perfume oil(s)" are used synonymously. They are in particular taken to mean all those substances or mixtures thereof which are perceived by humans as an odor, in particular as an odor pleasant to humans and so trigger a pleasant odor sensation.

Perfumes, perfume oils or perfume oil constituents may be used as scent components. According to the invention, perfume oils or scents may be individual odorant compounds, for example synthetic products of the ester, ether, aldehyde, ketone, alcohol and hydrocarbon type. Odorant compounds of the ester type are for example benzyl acetate, phenoxyethyl isobutyrate, p-tert.-butylcyclohexyl acetate, linalyl acetate, dimethylbenzylcarbinyl acetate (DMBCA), phenylethyl acetate, benzyl acetate, ethylmethylphenyl glycinate, allylcyclohexyl propionate, styrallyl propionate, benzyl salicylate, cyclohexyl salicylate, floramat, melusate and jasmecyclate. Ethers include, for example, benzyl ethyl ether and ambroxan, aldehydes for example include linear alkanals with 8-18 C atoms, citral, citronellal, citronellyloxyacetaldehyde, cyclamen aldehyde, lilial and bourgeonal, ketones include, for example, ionones, alpha-isomethyl ionone and methyl cedryl ketone, alcohols include anethole, citronellol, eugenol, geraniol, linalool, phenylethyl alcohol and terpineol, hydrocarbons mainly include terpenes such as limonene and pinene. Preferably, however, mixtures of various odorants are used which together produce an attractive scent note.

Such perfume oils may also contain natural odorant mixtures, as are obtainable from plant sources, for example pine, citrus, jasmine, patchouli, rose or ylang-ylang oil. Muscatel oil, sage oil, camomile oil, clove oil, melissa oil, mint oil, cinnamon leaf oil, lime blossom oil, juniper berry oil, vetiver oil, olibanum oil, galbanum oil and labdanum oil and orange-blossom oil, neroli oil, orange peel oil and sandalwood oil are likewise suitable.

If it is to be perceptible, an odorant must be volatile, an important role also being played by molar mass, in addition to the nature of the functional groups and the structure of the chemical compound. Most odorants accordingly have molar masses of up to approximately 200 Daltons, while molar masses of 300 Daltons and above tend to be the exception. Due to the differing volatility of odorants, the odor of a perfume or scent composed of two or more odorants varies over the course of vaporization, it being possible to subdivide odor impressions into "head or top note", "heart or middle note" and "end note or dry-out". Since odor perception largely also depends on odor intensity, the head note of a perfume or scent does not solely consist of highly volatile compounds, while the end note largely consists of less volatile, i.e. tenacious odorants. When formulating perfumes, more highly volatile odorants may, for example, be bound to certain fixatives, so preventing them from vaporizing rapidly. Accordingly, in the following classification of odorants into "more highly volatile" or "tenacious" odorants, no statement is made about odor impression nor about whether the corresponding odorant is perceived as a top or heart note. Tenacious odorants which may be used for the purposes of the present invention are, for example, essential oils such as angelica root oil, anise oil, arnica blossom oil, basil oil, bay oil, bergamot oil, champak flower oil, silver fir oil, silver fir cone oil, elemi oil, eucalyptus oil, fennel oil, spruce-needle oil, galbanum oil, geranium oil, ginger grass oil, guaiacwood oil, gurjun balsam oil, helichrysum oil, ho oil, ginger oil, iris oil, cajeput oil, calamus oil, chamomile oil, camphor oil, canaga oil, cardamom oil, cassia oil, pine-needle oil, copaiba balsam oil, coriander oil, spearmint oil, caraway oil, cumin oil, lavender oil, lemongrass oil, lime oil, mandarin oil, melissa oil, ambrette oil, myrrh oil, clove oil, neroli oil, niaouli oil, olibanum oil, orange oil, origanum oil, palmarosa oil, patchouli oil, Peru balsam oil, petitgrain oil, pepper oil, peppermint oil, pimento oil, pine oil, rose oil, rosemary oil, sandalwood oil, celery oil, spike oil, star anise oil, turpentine oil, thuja oil, thyme oil, verbena oil, vetiver oil, juniper berry oil, wormwood oil, wintergreen oil, ylang-ylang oil, hyssop oil, cinnamon oil, cinnamon leaf oil, citronellol, lemon oil and cypress oil. Higher-boiling or solid odorants of natural or synthetic origin may, however, also be used for the purposes of the present invention as tenacious odorants or odorant mixtures, i.e. scents. These compounds include the compounds stated below and mixtures thereof: ambrettolide, α-amylcinnamaldehyde, anethole, anisaldehyde, anisyl alcohol, anisole, methyl anthranilate, acetophenone, benzyl acetone, benzaldehyde, benzoic acid ethyl ester, benzophenone, benzyl alcohol, benzyl acetate, benzyl benzoate, benzyl formate, benzyl valerate, borneol, bornyl acetate, α-bromostyrene, n-decylaldehyde, n-dodecylaldehyde, eugenol, eugenol methyl ether, eucalyptol, farnesol, fenchone, fenchyl acetate, geranyl acetate, geranyl formate, heliotropin, methyl heptine carbonate, heptaldehyde, hydroquinone dimethyl ether, hydroxycinnamaldehyde, hydroxycinnamyl alcohol, indole, irane, isoeugenol, isoeugenol methyl ether, isosafrole, jasmone, camphor, carvacrol, carvone, p-cresol methyl ether, coumarin, p-methoxyacetophenone, methyl N-amyl ketone, methylanthranilic acid methyl ester, p-methylacetophenone, methylchavicol, p-methylquinoline, methyl β-naphthyl ketone, methyl n-nonylacetaldehyde, methyl n-nonyl ketone, muscone, β-naphthol ethyl ether, β-naphthol methyl ether, nerol, nitrobenzene, n-nonylaldehyde, nonyl alcohol, n-octylaldehyde, p-oxyacetophenone, pentadecanolide, β-phenyl ethyl alcohol, phenylacetaldehyde dimethyl acetal, phenylacetic acid, pulegone, safrole, isoamyl salicylate, methyl salicylate, hexyl salicylate, cyclohexyl salicylate, santalol, skatole, terpineol, thymene, thymol, γ-undecalactone, vanillin, veratrumaldehyde, cinnamaldehyde, cinnamyl alcohol, cinnamic acid, ethyl cinnamate, benzyl cinnamate.

More highly volatile odorants include in particular lower-boiling odorants of natural or synthetic origin, which may be used alone or in mixtures. Examples of more highly volatile odorants are alkyl isothiocyanates (alkyl mustard oils), butanedione, limonene, linalool, linalyl acetate and propionate, menthol, menthone, methyl-n-heptenone, phellandrene, phenylacetaldehyde, terpinyl acetate, citral, citronellal.

Solid agents according to the invention, such as in particular washing or cleaning agents, may be produced in a manner known in principle, for example by spray drying or granulation, with for example optional peroxy compound and optional bleach catalyst optionally being added subsequently. The reaction product according to the invention is preferably introduced into the agent at the end of production, preferably by being sprayed on, in particular together with further odorants or with a perfume oil. Agents according to the invention, for example washing or cleaning agents, with an elevated bulk density, in particular in the range from 650 g/l to 950 g/l, may preferably be produced by a method comprising an extrusion step. Liquid agents according to the invention, for example washing or cleaning agents, may likewise be produced in a manner known per se, the reaction product according to the invention preferably being introduced into the agent, for example washing or cleaning agent, at the end of production, in particular together with further odorants or with a perfume oil.

According to a preferred embodiment, the teaching according to the invention may be used to reduce the perfume content in the agents in question, for example laundry post-treatment agents, since particularly efficient perfuming, which is the result of targeted scent release, can be ensured by incorporating the reaction product according to the invention.

A preferred washing or cleaning agent according to the invention is a solid, in particular pulverulent, washing agent which, in addition to reaction product according to the invention, may preferably contain components which are selected from the following:

(a) anionic surfactants, such as preferably alkylbenzenesulfonate, alkyl sulfate, for example in quantities of preferably 5-30 wt. %

(b) nonionic surfactants, such as preferably fatty alcohol polyglycol ethers, alkyl polyglucoside, fatty acid glucamide, for example in quantities of preferably 0.5-15 wt. %

(c) builders, such as for example polycarboxylate, sodium citrate, in quantities of for example 0-70 wt. %, advantageously 5-60 wt. %, preferably 10-55 wt. %, in particular 15-40 wt. %, (d) alkalis, such as for example sodium carbonate, in quantities of for example 0-35 wt. % advantageously 1-30 wt. %, preferably 2-25 wt. %, in particular 5-20 wt. %, (e) bleaching agents, such as for example sodium perborate or sodium percarbonate, in quantities of for example 0-30 wt. % advantageously 5-25 wt. %, preferably 10-20 wt. %, (f) corrosion inhibitors, for example sodium silicate, in quantities of for example 0-10 wt. %, advantageously 1-6 wt. %, preferably 2-5 wt. %, in particular 3-4 wt. %, (g) stabilizers, for example phosphonates, advantageously 0-1 wt. %, (h) foam inhibitors, such as for example soap, silicone oils, paraffins, advantageously 0-4 wt. %, preferably 0.1-3 wt. %, in particular 0.2-1 wt. %, (i) enzymes, such as for example proteases, amylases, cellulases, lipases, advantageously 0-2 wt. %, preferably 0.2-1 wt. %, in particular 0.3-0.8 wt. %, (j) graying inhibitors, for example carboxymethylcellulose, advantageously 0-1 wt. %, (k) discoloration inhibitors, for example polyvinylpyrrolidone derivatives, for example 0-2 wt. %, (l) adjusting agents, for example sodium sulfate, advantageously 0-20 wt. %, (m) optical brighteners, for example stilbene derivative, biphenyl derivative, advantageously 0-0.4 wt. %, in particular 0.1-0.3 wt. %, (n) optionally further odorants, (o) optionally water, (p) optionally soap, (q) optionally bleach activators, (r) optionally cellulose derivatives, (s) optionally soil repellents, wt. % in each case relative to the entire agent.

In a further preferred embodiment, the washing or cleaning agent according to the invention is in solid, in particular particulate, form and, in addition to the reaction product according to the invention, additionally contains 5 wt. % to 55 wt. % builders, 2.5 wt. % to 20 wt. % anionic surfactant, 1 wt % to 20 wt. % nonionic surfactant, 1 wt. % to 25 wt. % bleaching agents, 0.5 wt. % to 8 wt. % bleach activator and 0.1 wt. % to 40 wt. % adjusting agent, in particular alkali metal sulfate, together with up to 2 wt. %, in particular 0.4 wt. % to 1.2 wt. % enzyme, preferably enzyme formulated in particulate form, in particular protease, lipase, amylase, cellulase and/or oxidoreductase. This embodiment may optionally also contain neither bleaching agent nor bleach activator.

In another preferred embodiment of the invention, the washing or cleaning agent according to the invention is in liquid form, preferably in gel form. Preferred liquid washing or cleaning agents have water contents of for example 10-95 wt. %, preferably 20-80 wt. % and in particular 30-70 wt. %, relative to the entire agent. In the case of liquid concentrates, the water content may also be particularly low, for example amounting to ≤30 wt. %, preferably ≤20 wt. %, in particular ≤15 wt. %, such as for example 0.1 to 10 wt. %, wt. % in each case relative to the entire agent. The liquid agents may also contain nonaqueous solvents.

A preferred washing or cleaning agent according to the invention is a liquid, in particular gel form, washing agent which, in addition to the reaction product according to the invention, may preferably contain components which are preferably selected from the following:

- anionic surfactants, such as preferably alkylbenzenesulfonate, alkyl sulfate, for example in quantities of preferably 5-40 wt. %
- nonionic surfactants, such as preferably fatty alcohol polyglycol ether, alkyl polyglucoside, fatty acid glucamide, for example in quantities of preferably 0.5-25 wt. %
- builders, such as for example polycarboxylate, sodium citrate, advantageously 0-25 wt. %, preferably 0.01-10 wt. %, in particular 0.1-5 wt. %,
- foam inhibitors, for example silicone oils, paraffins, in quantities of for example 0-10 wt. %, advantageously 0.1-4 wt. %, preferably 0.2-2 wt. %, in particular 1-3 wt. %,
- enzymes, for example proteases, amylases, cellulases, lipases, in quantities of for example 0-3 wt. %, advantageously 0.1-2 wt. %, preferably 0.2-1 wt. %, in particular 0.3-0.8 wt. %, optical brighteners, for example stilbene derivative, biphenyl derivative, in quantities of for example 0-1 wt. %, advantageously 0.1-0.3 wt. %, in particular 0.1-0.4 wt. %, optionally further odorants, water optionally soap, in quantities of for example 0-25 wt. %, advantageously 1-20 wt. %, preferably 2-15 wt. %, in particular 5-10 wt. %, optionally solvents (preferably alcohol), advantageously 0-25 wt. %, preferably 1-20 wt. %, in particular 2-15 wt. %, wt. % in each case relative to the entire agent.

A particularly preferred liquid washing or cleaning agent here contains, in addition to the reaction product according to the invention, at least anionic surfactants in quantities of 0.5 wt. % to 20 wt. %, nonionic surfactants in quantities of 1 wt. % to 25 wt. %, builders in quantities of 1 to 25 wt. %, enzymes and water.

A further preferred washing or cleaning agent according to the invention is a liquid rinse conditioner which, in addition to the reaction product according to the invention, may preferably contain components which are selected from the following:

cationic surfactants, such as in particular ester quats, for example in quantities of 5-30 wt. %, cosurfactants, such as in particular glycerol monostearate, stearic acid, fatty alcohols and/or fatty alcohol ethoxylates, for example in quantities of 0-5 wt. %, preferably 0.1-4 wt. %, emulsifiers, such as in particular fatty amine ethoxylates, for example in quantities of 0-4 wt. %, preferably 0.1-3 wt. %, optionally further odorants, optionally colorants, preferably in the ppm range, solvents, such as in particular water, for example in quantities of 60-90 wt. %, wt. % in each case relative to the entire agent.

EXAMPLE

A solution of 11.8 grams (g) zinc acetate in 500 milliliters (mL) MeOH was reacted with a solution of 5.92 g KOH in 260 mL MeOH within one hour with stirring. The mixture was heated to 60° C. to this end. The reaction solution initially became turbid on heating to 60° C., before becoming clear again after about 1.5 hours. After 2 hours, heating was stopped and the resultant transparent solution containing ZnO particles was then transferred in such a way that the solution could not absorb any water. The solution was still completely transparent after approximately 1 week and had formed no precipitate.

The resultant solution of ZnO particles was then used for reaction with the scents.

To this end, 10 ml portions of the previously obtained solution of ZnO particles were combined with 2 ml of a 10% odorant solution in methanol and stirred for half an hour. The mutually independently used odorants were limonene, cashmeran, undecavertol, damascone and n-amyl salicylate.

The resultant reaction products of odorants with metal oxides were then applied by having smell strips of filter board (240 grams per square meter (g/m$^2$), length 135 millimeters (mm)×width 6 mm) dipped therein. The fresh odor impression emitted by the smell strips was then evaluated, specifically on a scale from 0 (=Odorless) to 10 (=very strong odor). The odor impression was then verified after 24 hours on the smell strips which had dried in the meantime. The odor impression obtained after moistening the smell strips with water was then verified (i.e. likewise after 24 hours). Verification was carried out by a panel of 5 people with odor training, the entire test being repeated twice. The stated values are the mean values from this verification.

The following values were obtained for the odorants which were applied by means of the reaction products:

Amyl Salicylate:

fresh odor impression directly after application: 8 odor impression after 24 hours: 1 odor impression after 24 hours and moistening the smell strips with water: 7

Cashmeran:

fresh odor impression directly after application: 8 odor impression after 24 hours: 1 odor impression after 24 hours and moistening the smell strips with water: 8

α-Damascone:

fresh odor impression directly after application: 7 odor impression after 24 hours: 2 odor impression after 24 hours and moistening the smell strips with water: 7

Limonene:

fresh odor impression directly after application: 7 odor impression after 24 hours: 1 odor impression after 24 hours and moistening the smell strips with water: 5

Undecavertol:

fresh odor impression directly after application: 7 odor impression after 24 hours: 2 odor impression after 24 hours and moistening the smell strips with water: 6

It was thus found that all the tested odorant reaction products after drying or after 24 hours again give rise to an intense odor action by moistening the smell strips. This was not observed when the pure odorants were applied.

These effects were also not found when the odorant reaction products were incorporated in washing or cleaning agents. In particular, when textiles were treated with surfactant-containing washing agents and rinse conditioners which contained the odorant reaction products, the scent of the treated laundry was revived by moistening the laundry.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A washing or cleaning agent comprising reaction products of odorants with metal oxides that are doped with metal nanoparticles with dimensions of ≤100 nm.

2. The agent of claim 1, wherein the metal oxides are selected from ZnO, $ZrO_2$, $Fe_2O_3$, $Fe_3O_4$, $Al_2O_3$, $TiO_2$, $CeO_2$ and/or $SnO_2$.

3. The agent of claim 1, wherein the metal oxides are doped with metal nanoparticles selected from gold, silver, platinum, palladium and/or iron nanoparticles.

4. The agent of claim 1, wherein the metal oxides have particle sizes of ≤1000 μm.

5. The agent of claim 4, wherein the particle sizes are ≤0.1 μm.

6. The agent of claim 1, wherein the odorants in the reaction product are selected from dihydromyrcenol, acedyl, propidyl, triplal, hexyl acetate, 2-tert.-butylcyclohexyl acetate, 4-tert.-butylcyclohexyl acetate, linalyl acetate, terpinyl acetate, ethylene brassylate, applelide, lilial, cyclamen aldehyde, cyclogalbanate, allyl amyl glycolate, ethyl-2-methyl butyrate, amyl acetate, 2-methylundecanal, decanal, dihydrofloriffone, florhydral, limonene, undecavertol, amyl salicylate, cashmeran, alpha-damascone, beta-damascone, delta-damascone, iso-damascone and/or damascenone.

7. The agent of claim 1, wherein the quantity of metal oxide present amounts to 0.00001 to 10 wt. % relative to the entire washing or cleaning agent.

8. The agent of claim 1, wherein the quantity of odorants present amounts to 0.00001 to 80 wt. % relative to the entire washing or cleaning agent.

9. The agent of claim 1, wherein the quantity of odorants present amounts to 0.01 to 15 wt. % relative to the entire washing or cleaning agent.

10. The agent of claim 1, further comprising 0.0001 to 95 wt. % of surfactants relative to the entire washing or cleaning agent.

11. The agent of claim 10, comprising 0.01 to 40 wt. % of surfactants relative to the entire washing or cleaning agent.

12. The agent of claim 1, wherein the reaction product of odorants with metal oxides was produced in a separate step prior to addition to the agent.

13. A method for producing a washing or cleaning agent of claim 1, comprising producing a reaction product of the odorants with the metal oxides and combining the reaction product with a washing or cleaning agent matrix.

14. A washing or cleaning method, comprising contacting hard and/or textile surfaces with a treatment liquid comprising an agent according to claim 1.

15. A method for fixing odorants on a hard and/or textile surface, the method comprising the step of:

treating the hard and/or textile surface with an aqueous liquid comprising reaction products of odorants with metal oxides that are doped with metal nanoparticles with dimensions of ≤100 nm over a period of from 5 seconds to 300 minutes at a temperature of below 95° C.

16. A method for targeted scent release on a hard and/or textile surface, the method comprising the steps of:

(a) treating the surface with an aqueous liquid comprising reaction products of odorants with metal oxides that are doped with metal nanoparticles with dimensions of ≤100 nm over a period of from 5 seconds to 300 minutes at a temperature of below 95° C., (b) leaving the treated surface to dry and, at a later point in time, (c) releasing scent by input of moisture.

* * * * *